US008526859B2

(12) United States Patent
Gilan et al.

(10) Patent No.: US 8,526,859 B2
(45) Date of Patent: Sep. 3, 2013

(54) CONDUCTIVITY SENSOR WITH CLEANING APPARATUS

(75) Inventors: Ziv Gilan, Ein-yahav (IL); Barry Oldfield, Boise, ID (US); Giries Kadis, Jaffa (IL); Gil Bar-Haim, Rishon le Tzion (IL); Michel Assenheimer, Kfar Sava (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 254 days.

(21) Appl. No.: 13/123,576

(22) PCT Filed: Nov. 13, 2008

(86) PCT No.: PCT/US2008/083365

§ 371 (c)(1),
(2), (4) Date: Apr. 11, 2011

(87) PCT Pub. No.: WO2010/056243

PCT Pub. Date: May 20, 2010

(65) Prior Publication Data

US 2011/0200363 A1 Aug. 18, 2011

(51) Int. Cl.
*G03G 15/10* (2006.01)

(52) U.S. Cl.
USPC ..... 399/237

(58) Field of Classification Search
USPC ..... 399/27, 29, 233, 237, 245
See application file for complete search history.

(56) References Cited

U.S. PATENT DOCUMENTS

| | | | | |
|---|---|---|---|---|
| 3,991,709 | A * | 11/1976 | Sato et al. | 118/612 |
| 5,386,224 | A | 1/1995 | Deur et al. | |
| 5,682,184 | A * | 10/1997 | Stephany et al. | 347/7 |
| 2003/0129004 | A1 * | 7/2003 | Cho et al. | 399/237 |
| 2007/0076023 | A1 | 4/2007 | Knierim et al. | |

FOREIGN PATENT DOCUMENTS

| | | |
|---|---|---|
| JP | 11-065297 | 3/1999 |
| JP | 2001239670 | 9/2001 |
| KR | 1020070039727 | 4/2007 |

* cited by examiner

*Primary Examiner* — David Gray
*Assistant Examiner* — Thomas Giampaolo, II

(57) ABSTRACT

A system and method for determining LEP ink conductivity are provided. A pair of electrodes is arranged to define a narrow gap there between. A non-conductive propeller rotates within the gap and causes liquid ink to flow over respective planar surfaces of the electrodes. The rotating propeller further prevents the accumulation of ink sludge on the planar surfaces of the electrodes within the gap. Electrical current is conducted between the electrodes. The electrical current is measured and the conductivity value of the ink determined there from.

12 Claims, 5 Drawing Sheets

CONDUCTIVITY SENSOR WITH CLEANING APPARATUS

BACKGROUND

Control of liquid ink conductivity is important to color consistency within the field of liquid electrophotographic printing (LEP). Toward that goal, a conductivity sensor is needed that can detect variations in the ink's electrical charge during the process of forming an image on media. One approach to measuring LEP ink conductivity is to use two electrodes that are separated, or gapped, by several hundred microns. A voltage of dozens to hundreds of volts is applied and the resulting electrical current between the electrodes is measured and used to determine the electrical conductivity of the ink.

An undesirable aspect of using a high-voltage electric field is that ink "sludge" tends to form on the electrodes. This sludge acts to disrupt or skew subsequent conductivity measurements, with increasing error in the readings as the sludge accumulates. Thus, some means of cleaning is required in order to prevent ink sludge accumulation on electrode surfaces. Furthermore, a fresh supply of the liquid ink must be provided to the electrode surfaces in order to ensure meaningful ink conductivity readings.

Accordingly, the embodiments described hereinafter were developed in light of these and other drawbacks associated with LEP ink conductivity measurements.

BRIEF DESCRIPTION OF THE DRAWINGS

The present embodiments will now be described, by way of example, with reference to the accompanying drawings, in which.

DETAILED DESCRIPTION

Introduction

A system and method are provided for determining ink conductivity in a liquid electrophotographic printing (LEP) context. A pair of electrodes is arranged to define a narrow gap there between. A non-conductive propeller rotates within the gap and causes liquid ink (i.e., imaging media) to flow over the respective, inward facing surfaces of the electrodes. The rotating propeller further prevents the accumulation of ink sludge within the gap and, in particular, on the inward facing surfaces of the electrodes. Pulses of electrical potential are selectively applied to the electrodes resulting in pulses of electrical current there between. The electrical current pulses are measured and used to determine the electrical conductivity value of the ink.

In one embodiment, an apparatus includes a first electrode and a second electrode, which are respectively disposed to define a gap there between. The apparatus also includes a propeller supported within the gap. The propeller is configured to cause a liquid ink to flow through the gap during rotation of the propeller. The propeller is further configured to prevent accumulation of ink sludge within the gap during rotation of the propeller.

In another embodiment, a method includes rotating a propeller so as to cause a liquid ink to flow through an electrode gap. According to the method, the rotating propeller also prevents accumulation of an ink sludge within the electrode gap.

In yet another embodiment, an apparatus includes a tank configured to contain a liquid ink. The apparatus also includes a pump supported within the tank, the pump being configured to cause a flow of the liquid ink. The pump is configured to be driven by the rotation of a pump shaft. The apparatus also includes a pair of electrodes supported within the tank and a propeller supported within the tank along the pump shaft. The propeller is configured to prevent ink sludge from accumulating on facing surfaces of the electrodes during rotation of the propeller.

System Overview

Figure 1:
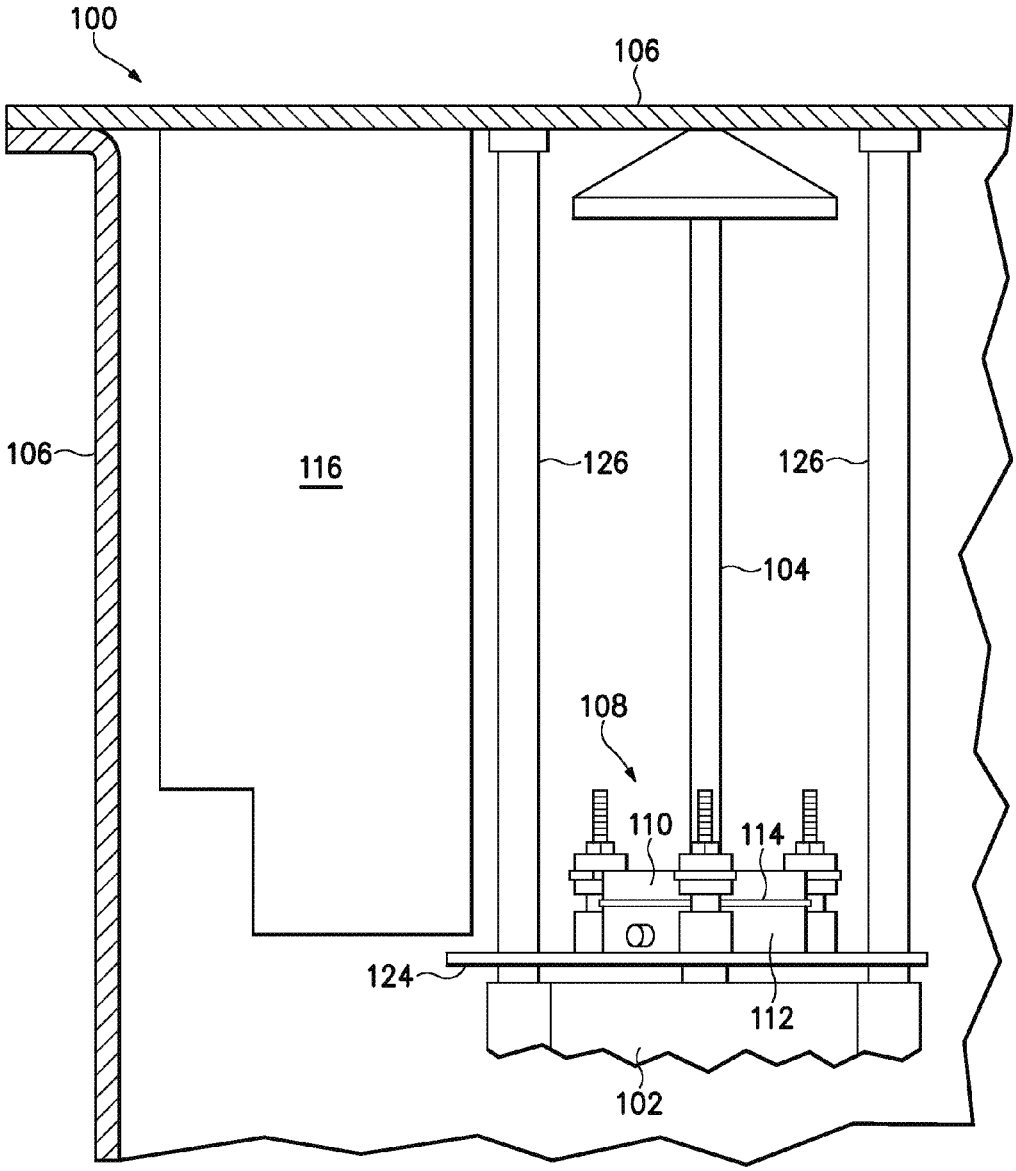
FIG. 1 depicts an illustrative conductivity measuring apparatus within an ink tank according to one embodiment.

FIG. 1 is a partial cutaway elevation view depicting an ink tank 100 including aspects of the present teachings. Ink tank 100 includes a pump 102 (shown in part). The pump 102 is configured for circulating liquid ink (i.e., imaging media) through conduits (not shown) of an imaging device such as an LEP printer. The pump 102 is coupled to a motor or other source of rotational drive by way of a pump shaft 104. Such motor (or other drive source) is located external to the housing 106 of the ink tank 100 and is not shown.

The ink tank 100 also includes a conductivity sensor (sensor) 108. The sensor 108 includes a first electrode 110 and a second electrode 112 supported in a stacked, separated relationship. The electrodes 110 and 112 are closely spaced so as to define a gap there between. In one embodiment, the gap is defined by a spacing of about one millimeter (i.e., 1 mm). Other suitable gaps can also be used. The sensor 108 is supported by a platen or deck 124, which in turn is secured to the housing 106 of the ink tank 100 by way of structural members 126.

In turn, the electrodes 110 and 112 are defined by respective planar surfaces which face into the gap defined between the electrodes 110 and 112. In one embodiment, the area of each respective planar surface is one thousand square millimeters (i.e., 1000 $mm^2$). Other electrodes having other respective planar areas can also be used. The electrodes 110 and 112 can be respectively formed from and/or surface plated with any suitable electrically conductive material such as, for non-limiting example, stainless steel, brass, gold, etc.

The sensor 108 further includes a propeller 114 supported within the gap between the electrodes 110 and 112. The propeller 114 is coupled to the pump shaft 104 and is configured to rotate when the pump shaft 104 is rotationally driven. The propeller 114 is supported in non-contacting close adjacency to each of the electrodes 110 and 112. The propeller 114 is formed of any suitable non-electrically conductive material. Non-limiting examples of propeller 114 materials include nylon, polyvinylchloride (PVC), plastic, etc.

The ink tank 100 also includes an electronics board 116. The electronics board 116 is coupled to the electrodes 110 and 112 of the sensor 108. The electronics board 116 includes electrical circuitry configured to measure the conductivity of liquid ink (i.e., media) in contact with the sensor 108.

During normal operations, the ink tank 100 is filled with liquid imaging media (i.e., ink) such that the sensor 108 and the pump 102 are respectively submerged. The electronics board 116 provides pulses of electrical voltage to the electrodes 110 and 112, resulting in pulses of electrical current flowing between the electrodes 110 and 112 through the liquid imaging media that is in contact therewith. In one embodiment, direct current (DC) pulses of four-hundred fifty volts are applied to the electrodes 110 and 112. Other suitable voltages can also be used. The electronics board 116 senses (i.e., measures) the pulses of electrical current and the electrical conductivity of the liquid imaging media is determined by way of processor operation and/or other resources of the electronics board 116.

During such normal operations, the propeller 114 is rotationally driven by way of the pump shaft 104 and serves to cause a flow of liquid imaging media through the gap between the electrodes 110 and 112. The flow of such liquid imaging media (Le., ink) is generally into the center area of the gap by way of central apertures in the electrodes 110 and 112, and then outward through the gap toward the circumferential edges of the electrodes 110 and 112.

The propeller 114 further serves to keep ink sludge and other debris from accumulating within the gap and/or on the inward facing surfaces of the electrodes 110 and 112. Such ink sludge and/or debris tend to have a distorting effect on the conductivity measurements made by way of the sensor 108. In this way, greater accuracy and reliability in the conductivity measurements is had due to the liquid flow and cleaning actions of the propeller 114. A boundary layer of liquid imaging media tends to keep the propeller 114 in close, non-contacting adjacency with the electrodes 110 and 112, being approximately centered in the gap there between. It is important to note that the conductivity measurements can be made whether the propeller 114 is presently being rotated or not. The sensor 108 is shown to operate by way of mechanical drive provided to the propeller 114 by way of the pump shaft 104. In another embodiment, a sensor in accordance with the present teachings can operate independent of any pump, wherein the propeller of such a sensor is rotationally driven by a motor or other means provided for that particular purpose. Other suitable configurations can also be used.

System Details

Figure 2:
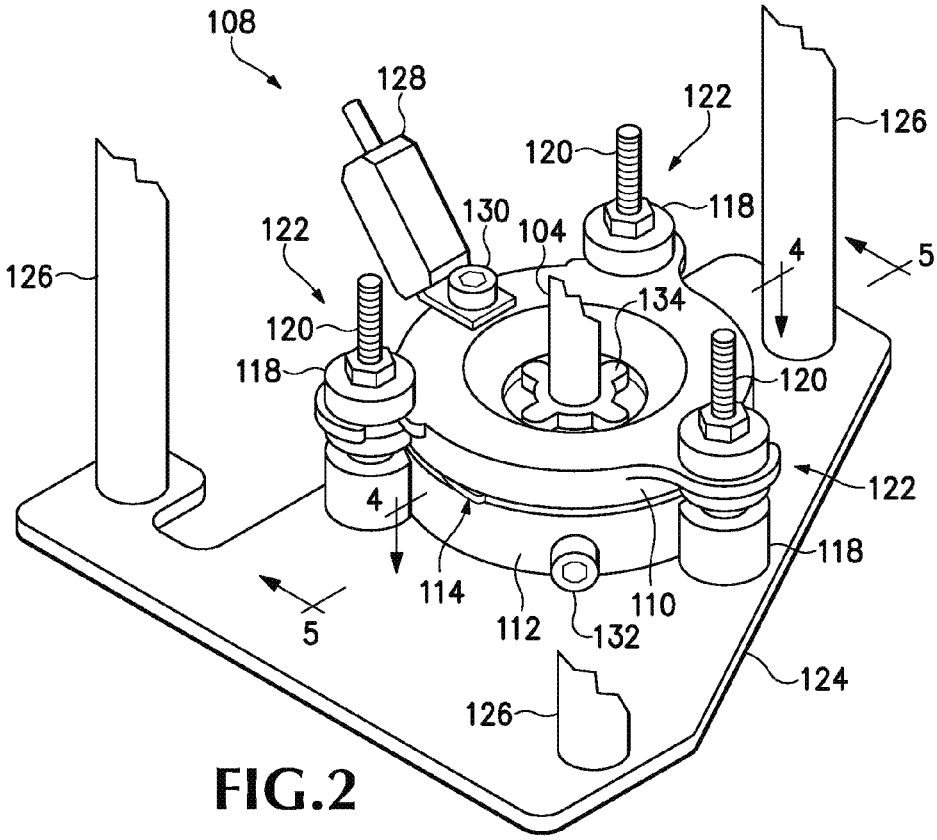
FIG. 2 depicts a perspective view of an illustrative conductivity sensor according to one embodiment.

FIG. 2 is a perspective view depicting the conductivity sensor 108 as introduced above. The first electrode 110 and the second electrode 112 are respectively defined by central apertures with the pump shaft 104 extending there through. The electrodes 110 and 112 are supported in spaced adjacency to each other by way of a triad of spacers 118 and associated fasteners (Le., nut and bolt assemblies) 120, thus defining three supports 122. The supports 122 are mechanically secured to the deck 124. The deck 124 is secured to the housing 106 of the ink tank 100 (FIG. 1) by way of three structural r embers 126.

The electrode 110 is electrically coupled to the electronics board 116 (FIG. 1) by way of a connector 128 and a fastener 130. The electrode 112 is similarly electrically coupled to the electronics board 116 by way of a fastener 132. Connector, wiring and/or other electrical elements associated with coupling the electrode 112 to the electronics board 116 are not shown in FIG. 2 in the interest of clarity. The propeller 114 is mechanically coupled to the pump shaft 104 by an adapter 134. The adapter 134 is formed from any suitable non-electrically conductive material such as, for example, nylon, plastic, PVC, etc. Other materials can also be used. In any case, the propeller 114 is rotationally driven by the pump shaft 104 by way of adapter 134.

Figure 3:
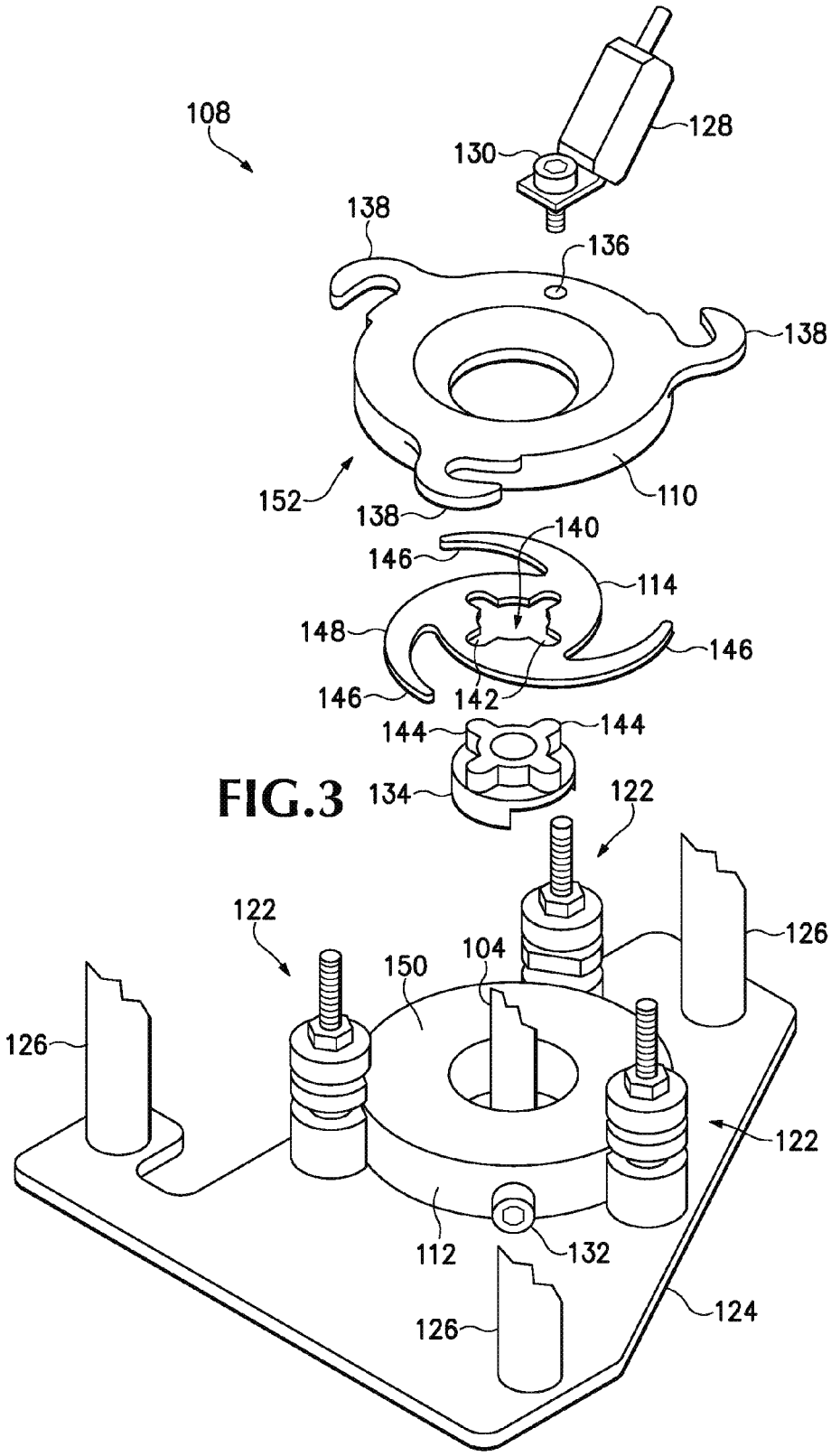
FIG. 3 depicts an exploded view of an illustrative conductivity sensor according to one embodiment.

FIG. 3 is an exploded view of the conductivity sensor 108 according to one embodiment. The first electrode 110 includes a threaded aperture 136 for receiving the fastener 130. The first electrode 110 also includes a triad of hook-like extensions 138 for mechanically engaging the respective supports 122 when the first electrode 110 is supported adjacent to the second electrode 112.

The propeller 114 includes (i.e., defines) a central aperture 140 including a pattern of four radial notches 142. In turn, the radial notches 142 receivingly engage raised portions 144 of the adapter 134. The propeller 114 is thus supported in non-slip engagement with the adapter 134 when the sensor 108 is fully assembled (e.g., FIG. 2). The propeller 114 includes (i.e., is defined by) a plurality of blades or outward extensions 146 respectively defined by opposite planar sides 148. The propeller 114 of FIG. 3 includes three blades 146. However, it is to be understood that the propeller 114 is illustrative and non-limiting, and that any suitable number of blades (e.g., two, four, five, etc.) can be used. Furthermore, the blades 146 are depicted as having a generally curved, swept-back design. Other blade geometries (not shown) can also be used. The propeller 114 is shaped so as to prevent flow stagnation of the liquid imaging media, as well as to prevent ink sludge from accumulating on the propeller 114 edges.

The second electrode 112 is defined by a planar surface 150. Similarly, the first electrode is defined by a planar surface 152. The respective planar surfaces 150 and 152 face into the gap defined between electrodes 110 and 112 when the sensor 108 is fully assembled (e.g., FIG. 2). It is to be further appreciated that the pump shaft 104 extends through respective apertures defined in the first and second electrodes 110 and 112, the propeller 114, and the adapter 134.

Figure 4:
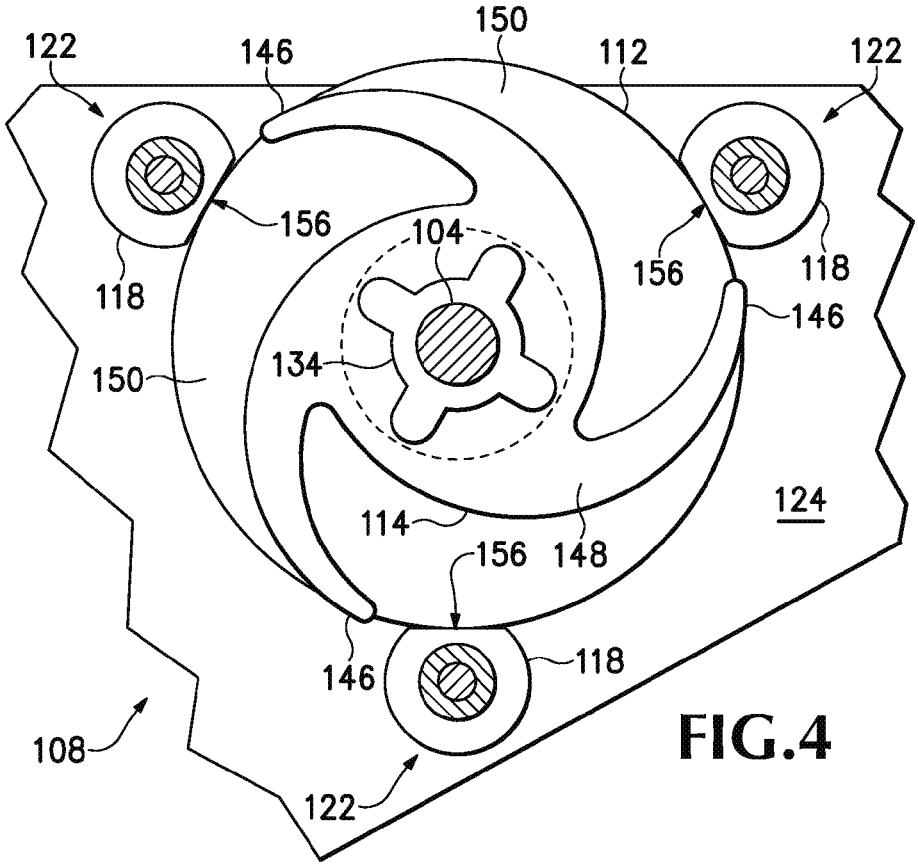
FIG. 4 depicts a plan view of a portion of an illustrative conductivity sensor according to one embodiment.

FIG. 4 is a plan view of a portion of the conductivity sensor 108. The propeller 114 is depicted supported about the pump shaft 104 by way of the adapter 134. Also depicted are the three respective supports 122. Each of the spacers 118 is defined by a planar face portion 156. The respective planar face portions 156 are disposed in contact with the second electrode 112 and serve to keep the second electrode 112 in an aligned, centered relationship with the first electrode 110 (FIG. 2) about the pump shaft 104.

Figure 5:
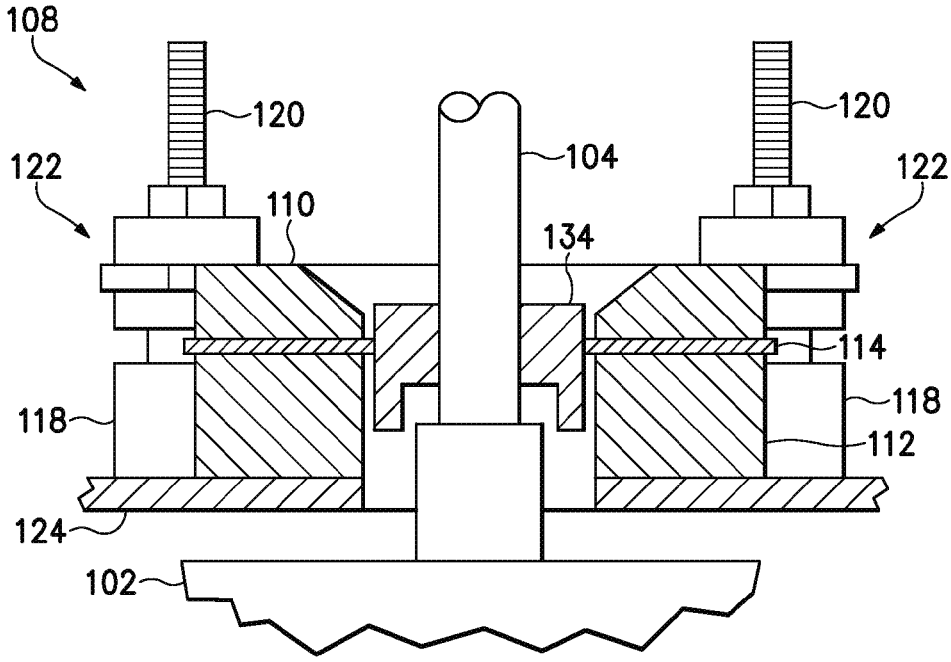
FIG. 5 depicts an elevation sectional view of an illustrative conductivity sensor according to one embodiment.

FIG. 5 is an elevation sectional view of the conductivity sensor 108. The first electrode 110 and the second electrode 112 are depicted in supported, spaced adjacency by way of the supports 122. The pump shaft 104 extends through sensor 108 and couples to the pump 102 (shown in part). The propeller 114 is shown supported on the pump shaft 104 by way of the adapter 134. It is to be understood that the propeller 114 is slightly separated from both of (is not contacting) the electrodes 110 and 112. In turn, the sensor 108 assembly is secured to and supported by the deck 124.

Exemplary Process

Figure 6:
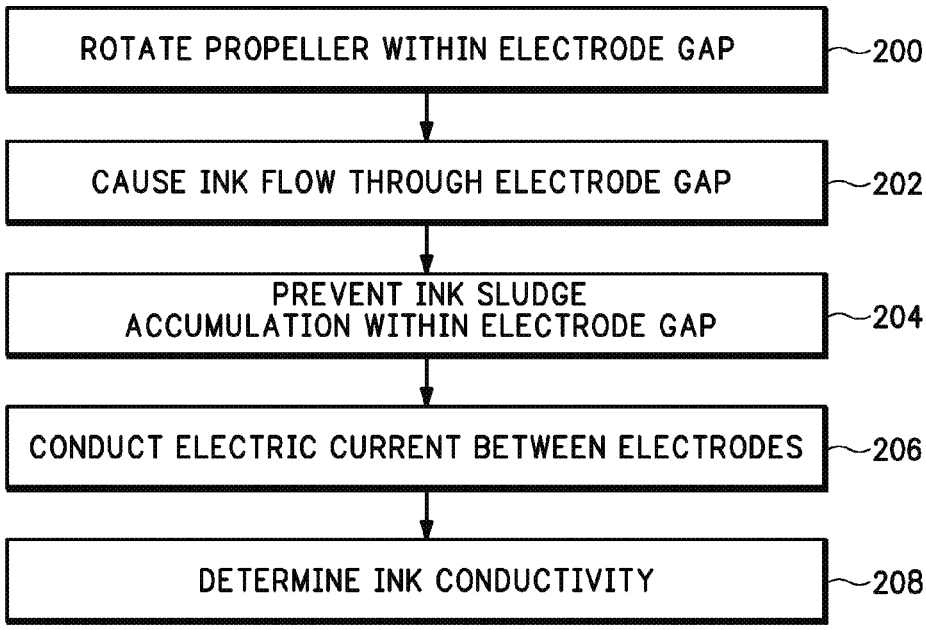
FIG. 6 depicts a flowchart of a method in accordance with one embodiment.

FIG. 6 is a flowchart depicting a method in accordance with one embodiment. The flowchart of FIG. 6 depicts particular method aspects and order of execution. However, it is to be understood that other methods including and/or omitting certain details, and/or proceeding in other orders of execution, can also be used without departing from the scope of the present teachings. Therefore, the method of FIG. 6 is illustrative and non-limiting in nature.

At 200, a propeller 114 is rotated within a gap defined between electrodes 110 and 112. At 202, the rotating propeller 114 causes liquid ink (Le., imaging media) to flow through the electrode gap. Such flow of liquid ink is generally outward though the gap toward the circumferential edges of the electrodes 110 and 112. At 204, ink sludge and/or other debris is prevented from accumulating within the gap and/or on the inward facing surface of the electrodes by virtue of the rotating propeller action. At 206, an electrical current is caused to flow between the electrodes and through the liquid ink in contact with the electrodes. Also, one or more characteristics of the electric current (e.g., peak magnitude, decay rate, etc.) is measured by corresponding electronic circuitry. Al 208, the measured electrical current characteristics are used to determine the electrical conductivity of the liquid ink. The conductivity determination can then be used to control one or more aspects of a printing operation such as, for non-limiting example, adjustment of the liquid imaging media constituency, rate of printing, go/no-go printing decisions, etc.

Operating Concepts

Figure 7:
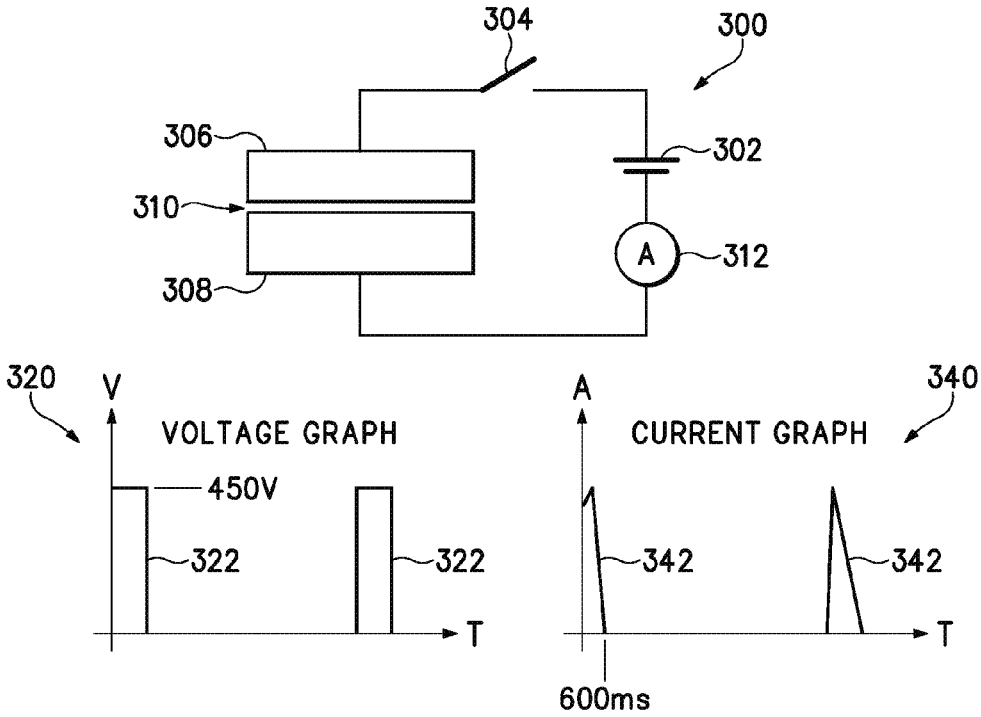
FIG. 7 depicts a schematic diagram and respective signal diagrams according to concepts of the present teachings.

FIG. 7 includes a schematic diagram of a circuit 300 and a voltage signal diagram 320 and a current signal diagram 340 corresponding to operational concepts of the present teachings. As such, the circuit 300 is a simplification of actual circuitry configured to perform methods of the present teachings. The circuit 300 is provided in the interest of clarity of understanding.

The circuit 300 includes a source of DC potential (i.e., voltage) 302 coupled to a switch 304. The circuit 300 also includes a first electrode 306 and a second electrode 308. The electrodes 306 and 308 are disposed in dose, spaced adjacency so as to define a narrow gap 310 there between. The gap 310 can also be referred to as an electrode gap. The electrodes 306 and 308 are submerged in liquid imaging media (L.e., ink) during operation of the circuit 300. The circuit 300 further includes current measurement means 312. The current measurement means 312 is depicted in FIG. 7 as an ammeter in the interest of simplicity, During illustrative and non-limiting operations, the switch 304 is selectively opened and dosed so as to provide pulses of electrical voltage 322 to the electrodes 306 and 308. Current flows in corresponding pulses 342 between the electrodes 306 and 308, through the liquid imaging media (not shown) in contact with the electrodes 306 and 308. These current pulses 342 also flow through the balance of the circuit 300 and are measured (i.e., indicated) by the current measurement means 312. The peak value, period, rise, decay, and/or other characteristics of the current pulses 342 can be used to determine the electrical conductivity of the liquid imaging media.

The immediately foregoing operations would normally result in the development and accumulation of ink sludge within the gap 310—namely, on the inward facing surfaces of the electrodes 306 and 308. Ink sludge and/or other debris within the gap 310 generally have a distorting effect on the current pulses used to determine the electrical conductivity of the liquid imaging media. The present teachings resolve the ink sludge accumulation problem through the use of a rotating propeller (e.g., propeller 114 of FIGS. 1-5) within the corresponding electrode gap.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. An apparatus, comprising:

a first electrode and a second electrode respectively disposed to define a gap there between, at least one of the electrodes defining an aperture there through; and a propeller supported within the gap, the propeller configured to cause a liquid ink to flow through the gap during rotation of the propeller, the propeller further configured to prevent accumulation of an ink sludge within the gap during rotation of the propeller, the propeller supported on a pump shaft, the pump shaft extending through the aperture of the at least one electrode.

2. The apparatus according to claim 1, wherein the propeller is formed of an electrically non-conductive material.

3. The apparatus according to claim 1 further comprising at least one spacer configured to support the first electrode and the second electrode in spaced adjacency thus defining the gap there between.

4. The apparatus according to claim 1 further comprising an adapter, the propeller rotatably supported on the pump shaft by way of the adapter.

5. The apparatus according to claim 1, wherein the propeller is defined by a plurality of blades, each blade defined by planar opposing sides.

6. The apparatus according to claim 1, wherein the first and second electrodes are each defined by a planar surface disposed to face into the gap.

7. The apparatus according to claim 6, wherein the propeller is further configured to prevent the ink sludge from accumulating on the planar surfaces of the first and second electrodes.

8. A method, comprising:

rotating a propeller so as to cause a liquid ink to flow through an electrode gap, the rotating propeller also preventing accumulation of an ink sludge within the electrode gap;

conducting an electric current between a pair of electrodes;

rotating a pump shaft within a through aperture of at least one electrode of the pair of electrodes, the propeller rotated by way of the rotating pump shaft; and determining a conductivity characteristic of the liquid ink by way of the electric current.

9. The method according to claim 8, wherein the propeller is rotating at the time of the conducting the electric current.

10. An apparatus, comprising:

a tank configured to contain a liquid ink;

a pump supported within the tank and configured to cause a flow of the liquid ink, the pump configured to be driven by rotation of a pump shaft;

a pair of electrodes supported within the tank, at least one electrode of the pair of electrodes defining an aperture there through the pump shaft extending through the aperture of the at least one electrode; and a propeller supported within the tank along the pump shaft, the propeller configured to prevent ink sludge from accumulating on facing surfaces of the electrodes during rotation of the propeller.

11. The apparatus according to claim 10 further comprising circuitry configured to:

conduct an electrical current between the pair of electrodes; and determine a conductivity value for the liquid ink within the tank in accordance the electrical current.

12. The apparatus according to claim 11, the apparatus configured such that the propeller is rotating at the time of the conducting the electrical current.

* * * * *

UNITED STATES PATENT AND TRADEMARK OFFICE

CERTIFICATE OF CORRECTION

PATENT NO. : 8,526,859 B2
APPLICATION NO. : 13/123576
DATED : September 3, 2013
INVENTOR(S) : Ziv Gilan et al.

It is certified that error appears in the above-identified patent and that said Letters Patent is hereby corrected as shown below:

In the Claims:

In column 6, line 50, in Claim 10, delete "through" and insert -- through, --, therefor.

In column 6, line 61, in Claim 11, after "accordance" insert -- with --.

Signed and Sealed this
Twelfth Day of November, 2013

Teresa Stanek Rea
*Deputy Director of the United States Patent and Trademark Office*